United States Patent [19]

Kobayashi

[11] 4,381,503

[45] Apr. 26, 1983

[54] COMBINATION TYPE FIRE DETECTOR

[75] Inventor: Shigeru Kobayashi, Tokyo, Japan

[73] Assignee: Nittan Company, Limited, Tokyo, Japan

[21] Appl. No.: 283,306

[22] Filed: Jul. 14, 1981

[30] Foreign Application Priority Data

Jul. 23, 1980 [JP] Japan ..... 55-103347[U]

[51] Int. Cl.[3] ..... G08B 17/04; G08B 17/06

[52] U.S. Cl. ..... 340/584; 340/521; 340/589; 340/598

[58] Field of Search ..... 340/589, 598, 584, 521, 340/522; 307/117; 337/298, 300; 357/28

[56] References Cited

U.S. PATENT DOCUMENTS 3,255,441 6/1966 Goodwin et al. ..... 340/589

3,717,860 2/1973 Tipton et al. ..... 340/589

4,072,933 2/1978 Pun ..... 340/521

OTHER PUBLICATIONS

"Temperature, Not Current Switches P-N-P Element", *Electronic Design 2,* Jan. 18, 1977, p. 32.

*Primary Examiner*—Glen R. Swann, III

*Attorney, Agent, or Firm*—Ladas & Parry

[57] ABSTRACT

By the employment of the heat-sensitive thyristor, the conventional rate-of-rise action fire detector having a diaphragm deformable by thermally expanding air in a restrictively vented air chamber is easily converted to a combination type fire detector with minimal redesigning or additional fabrication and with an efficient mounting of the thyristor on a metal casing defining the air chamber.

3 Claims, 4 Drawing Figures

COMBINATION TYPE FIRE DETECTOR

TECHNICAL FIELD

This invention relates to a fire detector, more particularly, a so-called combination type fire detector comprising a heat-sensing means which is provided with a diaphragm deformable according to expansion of air and a heat-sensitive thyristor in combination.

BACKGROUND OF THE INVENTION

The differential action fire detector or the rate-of-rise action fire detector as commonly called in the trade having a heat-sensitive part which comprises an air chamber provided with a vent and a diaphragm is well known. The fire detector of this type works when the ambient temperature rises at a rate greater than a predetermined rate of temperature rise.

The combination type fire detector, which is a rate-of-rise action fire detector having further incorporated therein a bimetal heat sensor that functions at a predetermined temperature, is disclosed, for instance, in Japanese Laid-Open Utility Model Publication No. 12309/80. The fire detector of this type is advantageous in that it is able to give an alarm both when the temperature rapidly rises and when the temperature rises to a predetermined temperature although not so rapidly.

However, the bimetal heat sensor is rather expensive, as a mechanism for sensing a predetermined temperature. Moreover, its performance is not so precise and reliable over many years. Also, it is rather bulky and it is impossible to convert a conventional rate-of-rise action fire detector into a combination type detector by simply incorporating a bimetal heat sensor therein. A combination type fire detector must be redesigned for the incorporation of a bimetal heat sensor. That is, in order for a bimetal heat sensor to function efficiently, it must be fixed to the heat-sensing plate of the air chamber of the rate-of-rise action fire detector. Therefore, a new heat-sensing plate therefor must be designed.

Rather recently, a new heat-sensitive semiconductor element called "heat-sensitive thyristor" has been developed, which is available, for instance, from Mitsubishi Electric Corporation under the tradename "Thermosensor". This semiconductor is now being used as a heat sensor element. The "Thermistor", a well-known conventional heat-sensitive semiconductor element changes its resistance with change in temperature. In other words, it is a heat-sensitive resistor element, and does not perform sharp switching action. The above-mentioned heat sensor element, the "heat-sensitive thyristor", is a semiconductor element, which performs switching action at a predetermined temperature like a bimetal heat sensor, but much more precisely. That is, the switching temperature can be altered by changing the resistance value between the gate and the anode, and therefore, it is more suitable than the conventional thermistor, for use in a fire detector.

DISCLOSURE OF THE INVENTION

According to this invention, in the combination type fire detector comprising a rate-of-rise action fire detector, which comprises an air chamber having a metal case with a vent, a differential diaphragm, a contact switch operated by deformation of the diaphragm and a supporting member, and is further provided with a heat sensor operable at a predetermined temperature; there is provided an improvement wherein the metal case comprises a metal case body and a lid plate having a differential diaphragm in the central part thereof, and wherein the heat sensor operable at a predetermined temperature is a heat-sensitive thyristor secured to a part of said metal case in close contact therewith.

In a more preferred embodiment, there is provided the improved combination type fire detector as described above, wherein the heat-sensitive thyristor is secured to the lid plate of said metal case and the lid plate is provided with at least two bolts extending outward from said lid plate, and the heat-sensitive thyristor is supported by one of the bolts by means of a thyristor supporting element held between the lid plate and the supporting member.

BRIEF DESCRIPTION OF THE DRAWINGS

The same reference numbers are used for the same members and elements throughout all the drawings.

DESCRIPTION OF THE PREFERRED EMBODIMENTS

Figure 1:
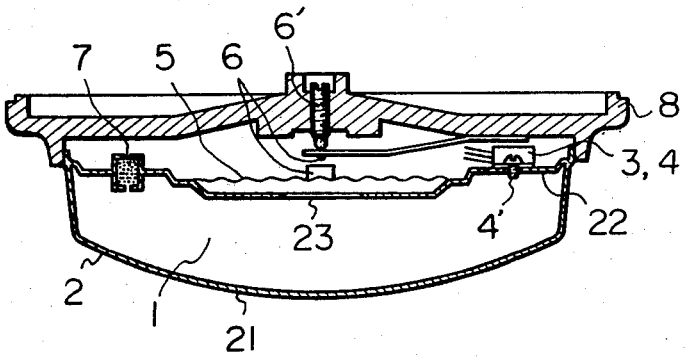
FIG. 1 is a cross-sectional view of an embodiment of the combination type fire detector in accordance with this invention.

The combination type fire detector of the embodiment shown in FIG. 1 comprises an air chamber 1 and a supporting member 8. The air chamber 1 comprises a metal case 2 and a differential diaphragm 5. The metal case comprises a case body 21 and a lid plate 22. The lid plate has a restricted vent or leak hole 7, the structure of which is known per se, and a recess in which an aperture 23 is provided. A differential diaphragm 5 is secured to the lid plate 22 so as to form a diaphragm chamber which communicates with the air chamber via said aperture 23 provided in the lid plate. A heat-sensitive thyristor 3 is secured to a part of the lid plate by means of a supporting element 4 and a screw as shown in an enlarged view in FIG. 2. The air chamber is generally of a squat cylindrical shape and secured to a corresponding supporting member 8. A contact switch means 6, which can be adjusted by an adjusting screw 6' fixed in the supporting member, is provided so as to operate the thus composed rate-of-rise action heat sensor. The supporting member 8 is generally made of an electric insulating material such as wood, plastic, etc.

Figure 2:
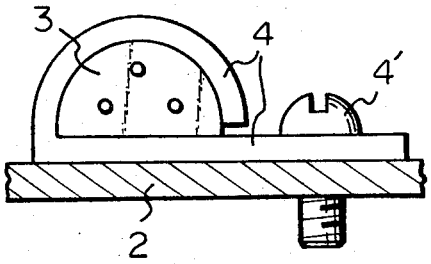
FIG. 2 is an enlarged cross-sectional view of the heat-sensitive thyristor and the supporting element therefor.
Figure 3:
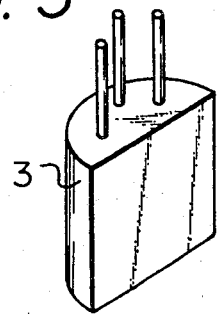
FIG. 3 is a perspective view of the heat-sensitive thyristor used in the combination type fire detector in accordance with this invention.

In the above-described embodiment, the used heat-sensitive thyristor is of semicylindrical shape and is secured to a part of the lid plate of the metal case by means of a supporting element 4 and a screw 4'. The supporting element is made of a good heat-conducting metal and consists of a flat strip and an arcuate arm which embraces the body of the heat-sensitive thyristor 3 as shown in FIG. 2. However, the position in which the heat-sensitive thyristor is secured is not limited to that mentioned above, and any position in the metal case will do.

The electric circuits for operating the diaphragm switch and the thyristor are known per se, so are not described here.

When this combination type fire detector is used; if a fire breaks out and causes the ambient temperature to rise sharply, the air in the air chamber expands rapidly and the expansion rate exceeds that of leakage through the vent 7, the expanded air, deforms the diaphragm upward and closes the contact switch 6, thus giving a fire alarm.

On the other hand, when the rise in the ambient temperature is slow and the expansion of the air in the air chamber is in balance with the leakage through the vent, the contact switch 6 will not close. In this case, however, the heat-sensitive thyristor works to trigger the fire alarm, since the heat received by the metal case 2 is readily transmitted to the heat sensitive thyristor 3 almost simultaneously with the rise in the ambient temperature and the heat-sensitive thyristor operates when the temperature reaches a predetermined temperature.

Figure 4:
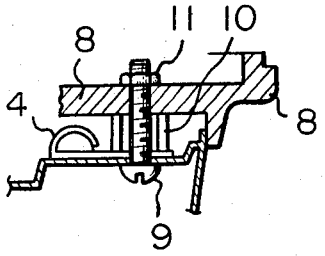
FIG. 4 is a partial cross sectional view of a more preferred embodiment of the combination type fire detector.

In a preferred embodiment of this invention, at least two threaded bolts 9 are provided on the lid plate of the metal case so that they project outward from the lid plate as shown in FIG. 4. To one of the bolts said supporting element 4 is mounted, and further a cylindrical element 10 of a suitable length is mounted thereon as a spacer and the projected end of the bolt is inserted into a hole provided in the supporting member 8 and secured thereto by means of a nut 11. When the fire detector is constructed like this, its assembly is most simple.

INDUSTRIAL APPLICABILITY

The combination type fire detector of this invention comprises a conventional so-called rate-of-rise action fire detector in which a heat-sensitive thyristor is secured on the surface of the metal case thereof with minimal additional fabrication. Therefore, this invention offers a compact combination type fire detector of simple structure, which is suitable for mass production.

I claim:

1. A combination type fire detector having a rate of rise thermal sensor in combination with a thermal sensor operative at a predetermined temperature, wherein said rate of rise thermal sensor comprises: a supporting member (8) of electrical insulating material; a metal casing (2) underlying said supporting member and being attached in supported spaced relation thereto, said casing having a hollow body (21) with a lid plate (23) including a restricted vent (7) placing the interior (1) of said hollow body in communication with the space between said casing and said supporting member, said lid plate being provided with an apertured central depression facing said supporting member; a diaphragm (5) carried by said lid plate and covering said central depression thereof so that the lower side of said diaphragm communicates through the aperture (23) of said central depression with said hollow body interior, whereby thermally expending air in said hollow body interior will deform said diaphragm upwardly when the expansion rate exceeds the leakage rate through said vent; and an alarm switch (6) having contacts which are respectively associated with said diaphragm and said supporting member and which are closed by upward deformation of said diaphragm; and wherein said thermal sensor comprises a heat sensitive thyristor (3) disposed in said space between said lid plate (23) and said supporting member (8), said thyristor having leads for connection to an alarm circuit and being bodily embraced by an arcuate arm of a flat metal strip (4) which lies atop said lid plate, there being a hollow open-ended cylindrical spacer (10) fitted between said flat strip and an overlying portion of said supporting member, and a screw (9) passing through said spacer and aligned holes in said lid plate, strip and supporting member, with a nut (11) tightened on a projecting end of said screw to securely clamp said strip against said lid plate.

2. A combination type fire detector according to claim 1, wherein said screw (9) is oriented so that said nut (11) is tightened against the upper surface of said overlying portion of said supporting member (8).

3. A combination type fire detector according to claim 1 or 2, wherein said heat sensitive thyristor (3) has a semi-cylindrical body which is complementary to the shape of said arcuate arm which embraces it, the flat side of said semi-cylindrical body interfacing with said flat metal strip (4).

* * * * *